United States Patent [19]

Odenthal

[11] Patent Number: 4,853,601

[45] Date of Patent: Aug. 1, 1989

[54] MULTIPLE BEAM ELECTRON DISCHARGE TUBE HAVING BIPOTENTIAL ACCELERATION AND CONVERGENCE ELECTRODE STRUCTURE

[75] Inventor: Conrad J Odenthal, Portland, Oreg.

[73] Assignee: Tektronix, Inc., Beaverton, Oreg.

[21] Appl. No.: 115,786

[22] Filed: Nov. 2, 1987

[51] Int. Cl.[4] ..... H01J 29/70; H01J 29/46; H01J 29/50

[52] U.S. Cl. ..... 315/368; 315/14; 313/412; 313/414

[58] Field of Search ..... 315/368, 15, 14; 313/412, 414, 449, 450

[56] References Cited

U.S. PATENT DOCUMENTS

| | | | |
|---|---|---|---|
| 3,327,160 | 6/1967 | Schlesinger | 315/17 |
| 3,375,390 | 3/1968 | Schlesinger | 313/83 |
| 3,798,478 | 3/1974 | Say | 313/70 R |
| 4,271,374 | 6/1981 | Kimura | 313/449 |
| 4,338,541 | 7/1982 | Beck | 313/412 |
| 4,353,061 | 10/1982 | Beck | 340/720 |
| 4,388,619 | 6/1983 | Beck | 340/727 |
| 4,543,508 | 9/1985 | Saito | 313/449 |

*Primary Examiner*—Thomas H. Tarcza
*Assistant Examiner*—Gregory C. Issing
*Attorney, Agent, or Firm*—John D. Winkelman; Mark M. Meininger; Paul S. Angello

[57] ABSTRACT

A multiple beam cathode-ray tube employs a bipotential electrode structure to provide acceleration and convergence of the electron beams without the use of a resistive helix coil. In a preferred embodiment, the bipotential electrode structure (10) is employed in a cathode-ray tube (14) in which a cathode (28) and a grid electrode structure (30) cooperate to form plural beams of high velocity electrons. The bipotential electrode structure includes an immersion lens cylinder (16) that is positioned upstream of a tubular electrode element (18). The outer diameter (226) of the immersion lens cylinder is less than the inner diameter (228) of the tubular electrode element, thereby allowing the downstream end of the immersion lens cylinder to extend into the upstream end of the tubular electrode element. A potential difference applied between the immersion lens cylinder and the tubular electrode element accelerates the electrons in the multiple beams and converges them to form an array of crossovers at a plane (64). Magnetic focus coils (54) image the array of crossovers on a display surface (36). Magnetic deflection coils (44) scan the electron beams in a raster pattern across the display surface to form a video display image thereon.

8 Claims, 4 Drawing Sheets

MULTIPLE BEAM ELECTRON DISCHARGE TUBE HAVING BIPOTENTIAL ACCELERATION AND CONVERGENCE ELECTRODE STRUCTURE

TECHNICAL FIELD

The present invention relates to electron beam discharge tubes and, in particular, to a multiple beam cathode-ray tube that employs a pair of adjacent tubular electrode elements to form a bipotential electrode structure for accelerating and converging the multiple electron beams.

BACKGROUND OF THE INVENTION

Multiple beam cathode-ray tubes generate, scan, and focus a plurality of electron beams as a group. Cathode-ray tubes of this type are capable of displaying pixel image data of high brightness at relatively high pixel data rates.

Multiple beam cathode-ray tubes typically include a resistive linear helix coil that is wound on the inner surface of the tube. A potential difference applied to the two ends of the helix coil generates a linearly varying potential along the length of the coil. This potential accelerates the electron beams and converges them onto an image surface that is positioned upstream of a display screen. Focus coils and deflection coils generate magnetic fields that, respectively, focus the image surface on and scan the electron beams across the display screen.

Cathode-ray tubes employing helix coils for acceleration and convergence of the electron beams typically include a drift tube section that receives a relatively low potential. As a consequence, such cathode-ray tubes suffer from unacceptable beam-to-beam compression. For increasing amounts of electron beam current, beam-to-beam compression is observed on the display screen as a narrowing of the vertical distance separating adjacent horizontal lines formed by the scan of the electron beams. Moreover, helix coils are expensive to manufacture and accumulate electrical charge during the operation of the cathode-ray tube. Charge accumulation on a helix coil generates spurious electric fields, which degrade the convergence performance of the helix coil and, thereby, cause a suboptimal focusing of images on the display screen.

SUMMARY OF THE INVENTION

An object of this invention is, therefore, to provide a multiple beam cathode-ray tube that is relatively inexpensive to manufacture.

Another object of this invention is to provide such a cathode-ray tube that does not employ a helix coil for acceleration and convergence of the multiple electron beams.

A further object of this invention is to provide in such a cathode-ray tube compensation for beam-to-beam compression.

The present invention is a bipotential acceleration and convergence electrode structure for use in a multiple beam cathode-ray tube. In a preferred embodiment, the cathode-ray tube includes a grid electrode structure that forms multiple electron beams an directs them along a drift tube section toward the bipotential electrode structure. The bipotential electrode structure includes an immersion lens cylinder that is positioned adjacent to and upstream of a tubular electrode element. The bipotential electrode structure does not employ a resistive helix coil, thereby making the cathode-ray tube relatively inexpensive to manufacture. A potential difference applied between the immersion lens cylinder and the tubular electrode element forms electric fields that accelerate and converge the electrons in the multiple beams.

The bipotential electrode structure of this invention provides stronger lensing action than that provided by the combination of an immersion lens cylinder and a helix coil. Moreover, the bipotential electrode structure allows the application of a relatively large potential to the drift tube section, which cooperates with the bipotential electrode structure and the grid electrode structure to compensate for beam-to-beam compression between adjacent ones of the multiple electron beams. Such a potential on the drift tube section requires, however, correspondingly large potentials between the electrodes comprising the grid electrode structure. A relatively large spacing between adjacent electrodes prevents arcing between them.

Additional objects and advantages of the present invention will be apparent from the following detailed description of a preferred embodiment thereof, which proceeds with reference to the accompanying drawings.

DESCRIPTION OF PREFERRED EMBODIMENT

Figure 1:
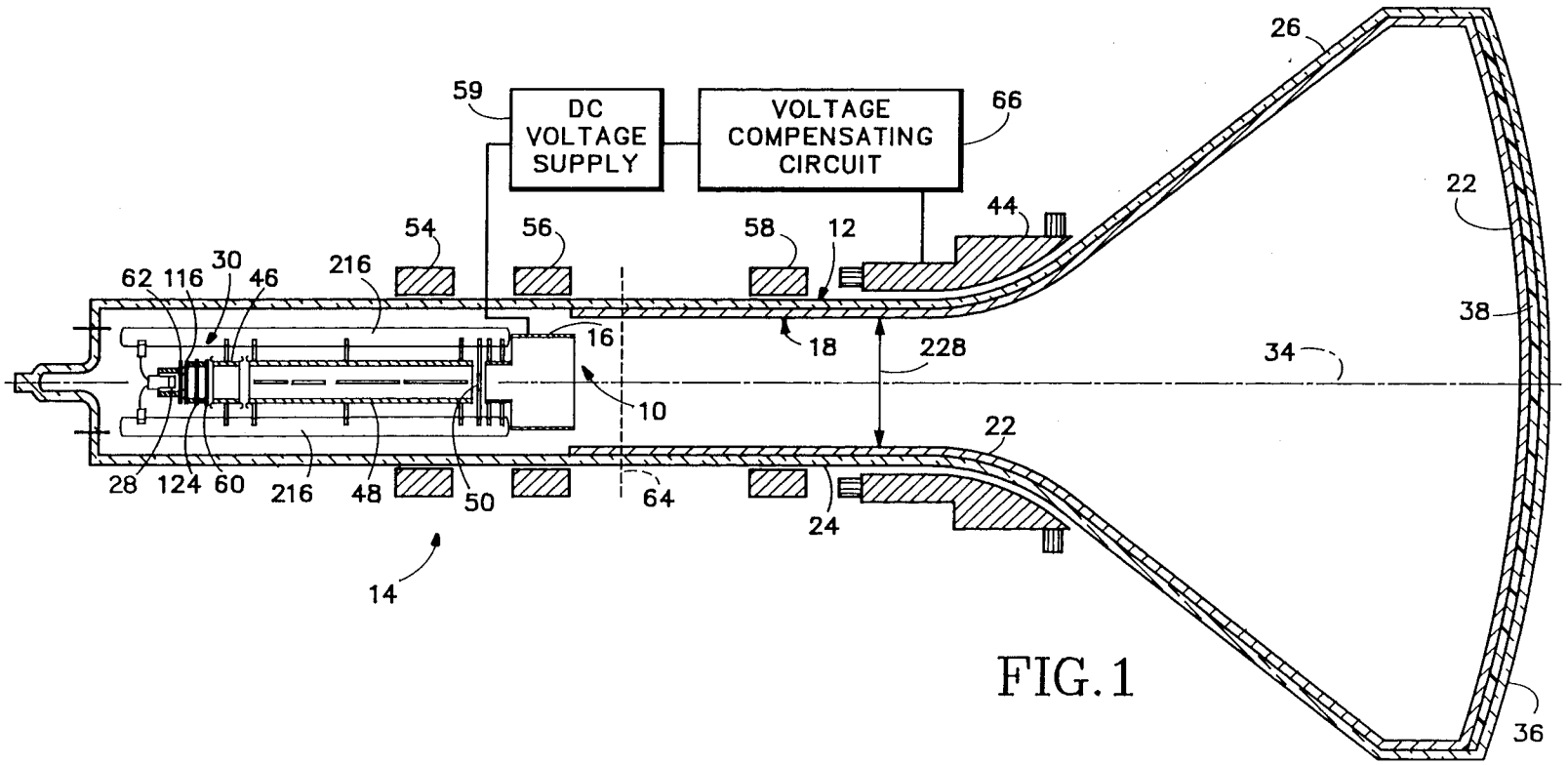
FIG. 1 is a schematic longitudinal section view of a multiple beam cathode-ray tube incorporating a bipotential acceleration and convergence electrode structure in accordance with the present invention.

With reference to FIG. 1, a bipotential acceleration and convergence electrode structure or means 10 of the present invention is contained within an evacuated envelope 12 of a multiple beam electron discharge tube 14. Bipotential electrode structure 10 comprises an immersion lens cylinder 16 and a tubular electrode element 18 that is formed by a conductive film 22 on the inner surface of a tubular glass neck 24 of envelope 12.

In a preferred embodiment, tube 14 is a cathode-ray tube with a relatively large screen (e.g., 48 cm diagonal) for a television-type monitor. Envelope 14 includes a tubular glass neck 24 and a glass funnel 26. A cathode 28 positioned within glass neck 24 at one end of envelope 12 cooperates with a grid electrode structure 30 to form plural narrow writing beams of high velocity electrons.

Grid electrode structure 30 includes four spaced-apart, disk-shaped electrodes. The beams of electrons propagate along a central longitudinal axis 34 toward a display screen or surface 36 positioned on the end of envelope 12 opposite to cathode 28. A layer 38 of phosphorescent material is coated on the inner side of display surface 36 to form a fluorescent screen for cathode-ray tube 14. Conductive film 22, which is electron-transparent, is deposited by evaporation on the inner surface of layer 38 of the phosphorescent material to provide a high-voltage electrode for display surface 36. Film 22 is also deposited on and extends along the inner surfaces of neck 24 and funnel 26 as will be described in greater detail below.

The beams of electrons strike film 22 on display surface 36 to form a video image in layer 38 of phosphorescent material . Cathode-ray tube 14 is preferably of the magnetically deflected type having a deflection yoke 44 that includes a horizontal deflection coil and a vertical deflection coil that deflect the electron beams in, respectively, the horizontal direction and the vertical direction in a conventional raster-scan pattern.

In a preferred embodiment, grid electrode structure 30 generates a bundle of eight individually modulated parallel beams of electrons that propagate along central longitudinal axis 34 in neck 24 to display surface 36. The eight electron beams exit grid electrode structure 30 in a generally circular off-axis array positioned around central longitudinal axis 34 and propagate through convergence electrode structure or means 46, which directs their propagation paths toward central longitudinal axis 34.

The electron beams propagate through a drift tube section 48 and converge toward the center of a limiting aperture electrode 50. The length of and the magnitude of a potential applied to drift tube section 48 affect the magnification of the size of the array. The converged bundle of electron beams exit limiting aperture electrode 50 and propagate through bipotential electrode structure 10. Immersion lens cylinder 16 and tubular electrode element 18 of bipotential electrode structure 10 are formed from electrically conductive materials and, in the presence of a potential difference applied between them, carry different potentials of substantially constant magnitude, as described in greater detail below. This characterizes electrode structure 10 as having a bipotential. (In contradistinction, a potential difference applied to opposite ends of a resistive helix coil generates a plurality of voltages along the length of the coil.)

As the beam current increases, bipotential electrode structure 10 cooperates with grid electrode structure 30 and drift tube structure 48 to maintain a uniform vertical distance between adjacent horizontal lines formed on display surface 36 by the raster-scanned electron beams. The electron beams are accelerated by an accelerating voltage of between 18 and 25 kV applied to conductive film 22, which extends from display surface 36, through funnel 26, and part way into neck 24. The accelerating voltage is delivered from the anode (not shown) of cathode-ray tube 14. The bundle of beams propagating along the length of neck 24 is subjected to conventional electromagnetic correction fields developed by rotation coils 54, astigmatism coils 56, and magnetic focus coils 58.

Immersion lens cylinder 16 and tubular electrode element 18 of bipotential electrode structure 10 are axially aligned with central longitudinal axis 34. The outer diameter of immersion lens cylinder 16 is less than the inner diameter of tubular electrode element 18 so that one end of immersion lens cylinder 16 extends into tubular electrode element 18. Immersion lens cylinder 16 is electrically connected to a DC voltage supply 59 of between 600 and 2,000 volts.

Bipotential electrode structure 10 employs tubular electrode structure 18, rather than a helix coil, to provide electron beam acceleration and convergence. It is believed that this electrode configuration forms between immersion lens cylinder 16 and tubular electrode element 18 equipotential lines that are more compressed than the equipotential lines that would be formed between a similar immersion lens and a helix coil. Bipotential electrode structure 10 generates, therefore, lensing action of greater strength than that which would be generated by an immersion lens cylinder and a helix coil. Certain components of cathode-ray tube 14 are designed to offset or weaken this lensing action to provide cathode-ray tube 14 with the appropriate amounts of electron beam acceleration and convergence.

The lensing action of bipotential electrode structure 10 is weakened primarily by applying a relatively large potential to drift tube section 48. The relatively large potential applied to drift tube section 48 requires that relatively large potentials be applied between the electrodes forming grid electrode structure 30. The spacing between electrodes in grid electrode structure 30 is made relatively large to prevent arcing between the electrodes. It is believed that, in addition to weakening the lensing action of bipotential electrode structure 10, the relatively large potential on drift tube section 48 allows less time for space charge interaction between adjacent electron beams. The result is an array of electron beams with increased brightness but without noticeable beam-to-beam compression. Moreover, in cathode-ray tubes having a 48 cm diagonal display screen, bipotential electrode structure 10 provides a cathode-ray tube having an overall length that is about 5 cm shorter than the length of a cathode-ray tube that employs a helix coil.

Grid electrode structure 30 includes an exit electrode 60 that has an array of apertures through which the eight electron beams propagate toward electrode structure 46. The electron beams emitted by cathode 28 propagate initially through a first planar grid electrode 62, which forms a first array of electron beam crossovers at exit electrode 60. The first array of crossovers is made as small as practicable to minimize the amount of demagnification that is required to produce on display surface 36 the desired vertical distance between adjacent horizontal lines formed by a raster scan of the electron beams in the array.

The voltage applied to drift tube section 48 controls the size of the array (i.e., the spacing between adjacent beams in the array) on display surface 36 by controlling the axial position of a second array of crossovers. For example, in a 2000 line, 25.4 cm high display, a first array of crossovers of 2.13 mm diameter can be reduced to a diameter of 0.889 mm. The electron lens formed by drift tube 48, electrode structure 46, and conductive film 18 accomplishes this size reduction by causing the array to be demagnified at the entrance of the accelerating field of conductive film 18. The second array of crossovers is then formed in an image surface on plane 64 that is located about 2.5 cm into the portion of neck 24 coated with conductive film 18. Magnetic focus coils 58, which are positioned downstream of image plane 64, image the second array of crossovers onto display surface 36. The production of the second array of crossovers facilitates a dynamic change in the array size in accordance with the scan position of the array.

The magnitude of the potential difference applied between immersion lens cylinder 16 and tubular electrode structure 18, which is substantially constant, affects the amount of magnification of the size of the array and the axial position of plane 64. Changes in the magnitude of the potential difference do occur, however, during the raster scan of the electron beams across the display screen. In particular, deflection yoke 44 typically produces less magnification of the array at the edges of the display screen than at its center. To maintain a constant array size across the display screen, a voltage compensating circuit 66 is electrically connected to DC voltage supply 59 and adjusts the potential difference applied between immersion lens cylinder 16 and tubular electrode element 18 in accordance with the magnitude of the deflection signal, thereby to compensate for magnification variations generated by deflection yoke 44. The changes in the magnitude of the potential difference are typically in the range of ±15% of the total potential difference. The magnitude of the potential difference is considered, therefore, to be substantially constant.

An image appearing on display surface 36 is rendered in a conventional raster-scan pattern and comprises, therefore, a series of parallel stripes. Each stripe includes plural sets of pixels spaced apart by equal distances in linear arrays along the length of the stripe. The number of linear arrays included in each stripe corresponds to the number of electron beams. Each of the linear arrays in a stripe is formed by a separate scan of one of the electron beams across display surface 36. Each stripe is formed by concurrently scanning the eight electron beams horizontally across display surface 36. The stripes in a series are, therefore, vertically stacked in raster-scan fashion on display surface 36 to synthesize an image that comprises a two-dimensional array of pixels.

Figure 2:
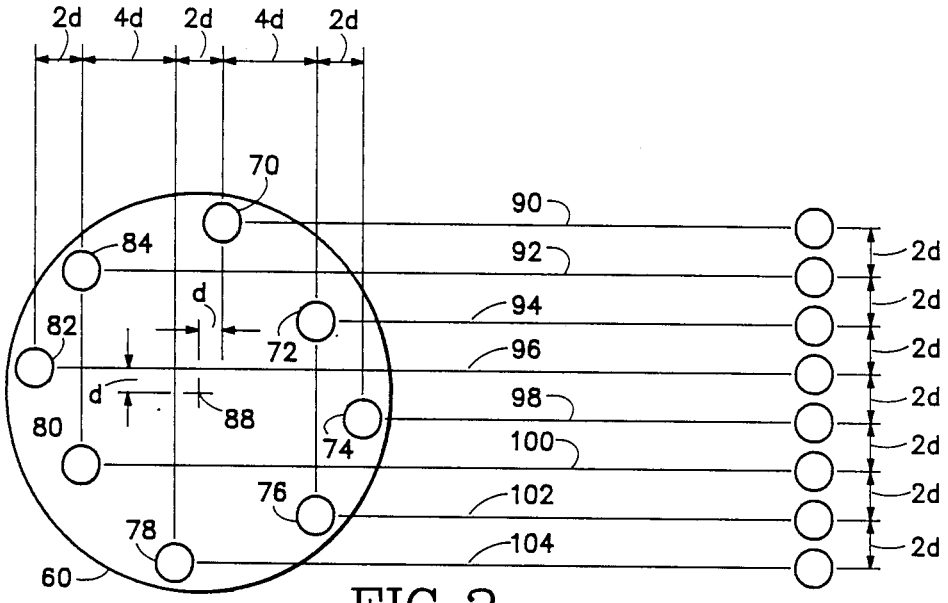
FIG. 2 is a diagram showing an array of grid electrode apertures that produce integer multiples of pixel spacing in both the horizontal and vertical directions on the display surface of the cathode-ray tube of FIG. 1.

FIG. 2 shows the preferred array geometry of eight grid apertures 70, 72, 74, 76, 78, 80, 82, and 84 that produce on display surface 36 pixel elements that are separated by integer multiples of unit pixel spacing in both the horizontal and vertical directions. The eight pixel elements in the array represent apertures in exit electrode 60 and the other electrodes included in grid electrode structure 30. Corresponding apertures in the electrodes are axially aligned so that the electrons emitted from cathode 28 propagate through the electrodes as a bundle of eight electron beams.

More specifically, the pixel array of grid electrode structure 30 comprises eight circular apertures 70, 72, 74, 76, 78, 80, 82, and 84 that are arranged in a generally circular off-axis pattern about a center point 88, which is coincident with central longitudinal axis 34. Adjacent apertures are spaced apart in both the horizontal and vertical directions by distances that differ by an integer multiple of a predetermined amount, "d," which in a preferred embodiment equals 0.1524 mm. The radius of each aperture is the same and equals 0.1524 mm. The horizontal and vertical distances between the apertures are shown in FIG. 2.

Scanning the electron beams horizontally produces eight horizontal lines 90, 92, 94, 96, 98, 100, 102, and 104 that are vertically spaced apart by a distance "2d" at exit electrode 60. The horizontal lines are vertically spaced apart on display surface 36 by a distance that is determined by the magnification required to provide the desired screen resolution. As was described above, the eight lines form a stripe. Whenever the pixel array is properly rotated, demagnified, scanned, focused, and astigmatized, there is vertically uniform line-to-line pixel spacing. Whenever the eight electron beams are individually modulated during a scan of the electron beams in accordance with appropriately timed video signals, video images are formed on display surface 36.

Figure 3:
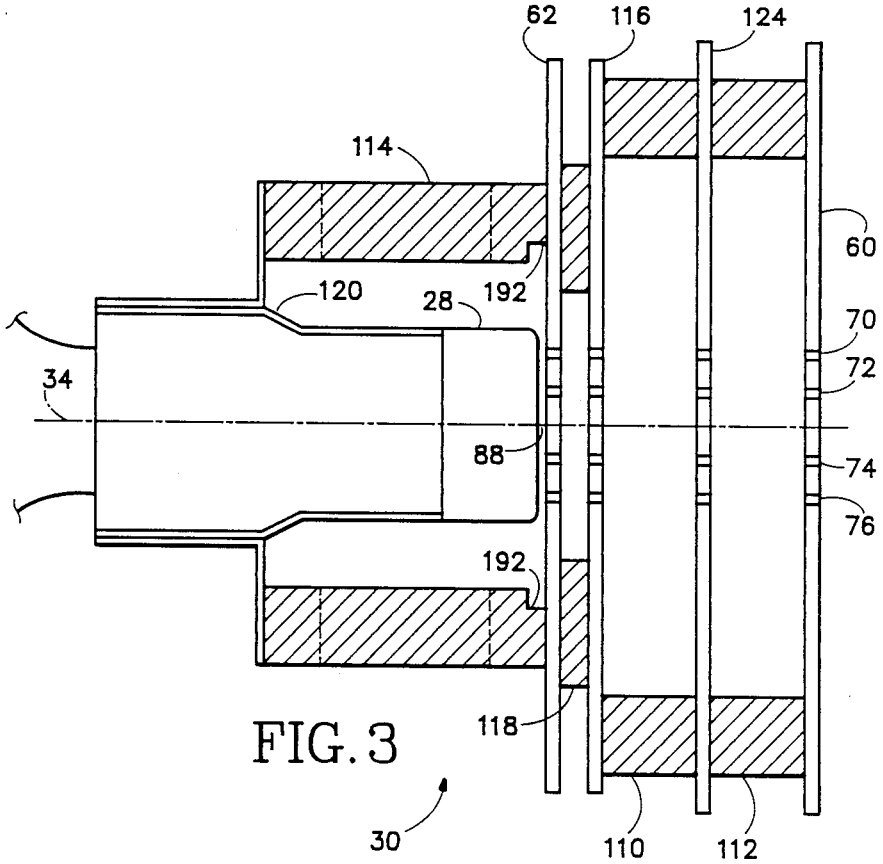
FIG. 3 is an enlarged cross-sectional view of the grid electrode structure employed in the cathode-ray tube of FIG. 1.

FIG. 3 is a cross-sectional view of grid electrode structure 30, which produces the eight individually modulated electron beams. With reference to FIG. 3, grid electrode structure 30 includes coaxially aligned first and second ceramic upper support cylinders 110 and 112, respectively, and ceramic lower support cylinder 114, which is separated from cylinders 110 and 112 by first planar grid electrode 62 and a second planar grid electrode 116. A ceramic annular insulator 118 electrically isolates and mechanically separates electrodes 62 and 116 so that different voltages can be applied to them.

Lower cylinder 114 supports a cathode support assembly 120 that positions cathode 28 proximally adjacent to electrode element 62. Upper cylinder 110 supports a third planar grid electrode 124, which is separated from grid electrode 116 by a relatively large distance so that a relatively large voltage difference can be applied between them. Upper cylinder 112 supports electrode 60 which, as was stated above, constitutes the exit electrode of grid electrode structure 30.

With reference to FIGS. 1–3, electrons emitted from cathode 28 propagate through the axially aligned apertures 70, 72, 74, 76, 78, 80, 82, and 84 in electrodes 62, 116, 124, and 60 to form the eight electron beams. The electron beams exit the apertures in electrode 60 and propagate through a convergence electrode structure 46, which converges the eight electron beams in the manner described below.

Each of the electrodes 116, 124, and 60 is of a disk shape whose apertures 70, 72, 74, 76, 78, 80, 82, and 84 are electrically common to one another. Electrode 62, which is called the "control grid electrode," is of a disk shape but is designed with radial slots so that a different electrical voltage can be applied to each of the eight apertures in it.

Each of electrodes 62, 116, 124, and 60 is preferably formed from a metal foil circular disk. Each of electrodes 62, 116, and 124 is of approximately 0.0762 mm thickness and 13.284 mm diameter. Electrode 60 is of approximately 0.127 mm thickness and 13.284 mm diameter. Each of electrodes 62, 116, 124 and 60 is brazed to the ones of ceramic annular insulator 118, cylinder 110, and cylinder 112 that separate it from the next adjacent electrodes. Annular insulator 118 is approximately of 0.254 mm thickness and has a 4.572 mm inner diameter. Upper cylinders 110 and 112 are approximately 1.27 mm in length and have a 10.16 mm inner diameter. Lower cylinder 114 is approximately 5.08 mm in length and has a 5.842 mm inner diameter.

Figure 4:
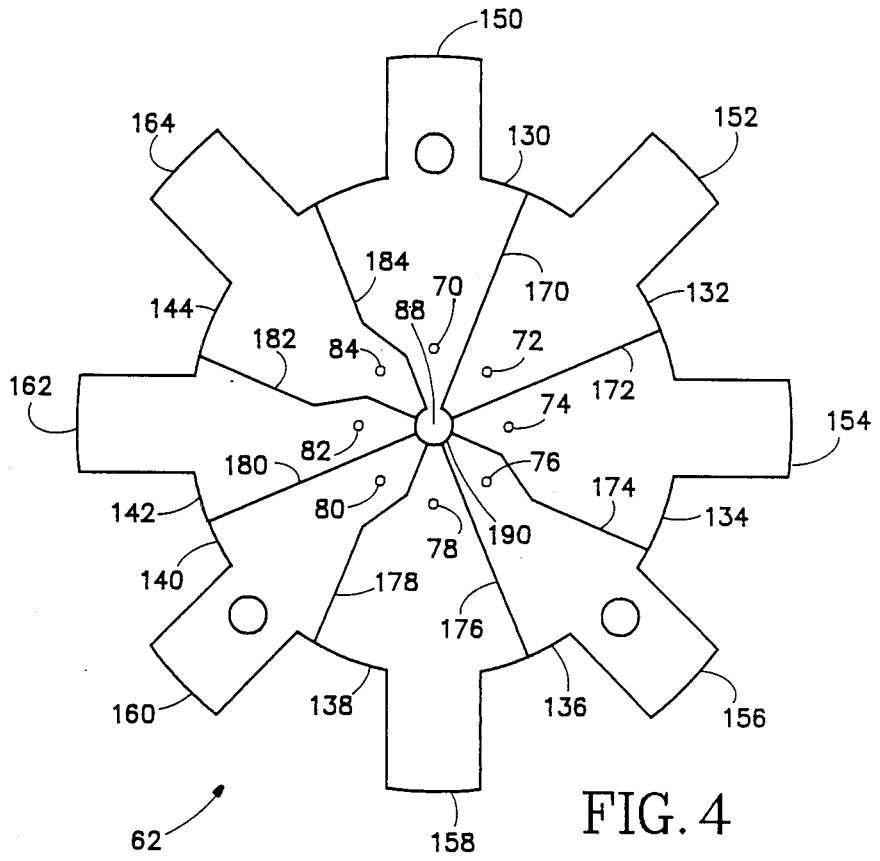
FIG. 4 is a diagram showing the surface of the control grid electrode that is included in the grid electrode structure of FIG. 3.

FIG. 4 shows the details of control grid electrode 62. With reference to FIG. 4, control grid electrode 62 is of circular shape and is divided into eight wedge-shaped segments 130, 132, 134, 136, 138, 140, 142, and 144 that have extending outwardly from their outer edges conducting tabs 150, 152, 154, 156, 158, 160, 162, and 164, respectively. The wedge segments are formed by cutting radial slots from the periphery to points near the center point 88 of the electrode. The slots bisect the linear distance between adjacent apertures but do not extend all the way to center point 88. Cutting the slots in this manner provides electrical isolation of the electron beams passing through the apertures of adjacent wedge segments.

The terminal points of the slots 170, 172, 174, 176, 178, 180, 182, and 184 that form segments 130, 132, 134, 136, 138, 140, 142, and 144 are cut to form a generally circular center tab 190 that is connected only to segment 130. Center tab 190 blocks the flow of electrons emitted from cathode 28 along central longitudinal axis 34 and prevents them from striking electrode 116. The blocking of electron flow by center tab 190 prevents unnecessary heating of electrode 116, which would cause secondary electron emission from electrode 116 or cause defamation of electrode 116 and a consequent misalignment of its apertures with the apertures of adjacent electrodes 62 and 124. The impact of electrons on electrode 116 could also cause secondary electron emission.

Slots 170, 172, 176, and 180 define straight lines, and slots 174, 178, 182, and 184 define dogleg profiles. The reason for the dogleg profiles is that lower cylinder 114 has eight slots 192 (FIG. 3—only two shown in phantom) positioned in equally spaced angular intervals around its periphery. The regions between adjacent slots 192 in lower cylinder 114 provide individual support surfaces for the wedge segments. The slots cut between adjacent apertures near the center of control grid electrode 62 do not, however, define wedge segments of equal angular extent because the aperture array does not define a true circle. As was stated above, an aperture array geometry of this character was required to create the horizontally and vertically uniform pixel spacing on display surface 36. The dogleg profiles of slots 176, 178, 182, and 184 facilitate, therefore, the formation of wedge segments of a size that align with the support surfaces of lower cylinder 114.

Since the wedge segments are electrically isolated from one another, the number of electrons propagating through any one of them can be separately controlled. This is accomplished by applying a voltage on the conductive tab of the desired wedge segment. Each one of the wedge segments of control grid 62 is biased at a negative potential relative to the ground potential on cathode 28, thereby to provide a standard triode operation. Each one of electrodes 116, 124, and 60 receives an applied voltage that is common to the apertures in it. Electrode 116 is used to adjust the electron beam cutoff voltage. The lowest cutoff voltage of any segment of control grid electrode 62 is −20 volts. To accomplish this, a voltage of between 200 volts and 500 volts is applied to electrode 116.

Electrode 124 cooperates with electrode 116 in collimating and accelerating the electron beams. The voltage applied to electrode 124 controls the divergence of each of the electron beams and thereby affects the brightness of the resulting image. The voltage applied to electrode 124 is between the voltages applied to electrodes 116 and 60, and typically ranges from 100 volts to 500 volts. Varying the voltage on electrode 124 from 600 volts to 140 volts varies the brightness of the image on display surface 36 from minimum brightness to maximum brightness, respectively.

Figure 5:
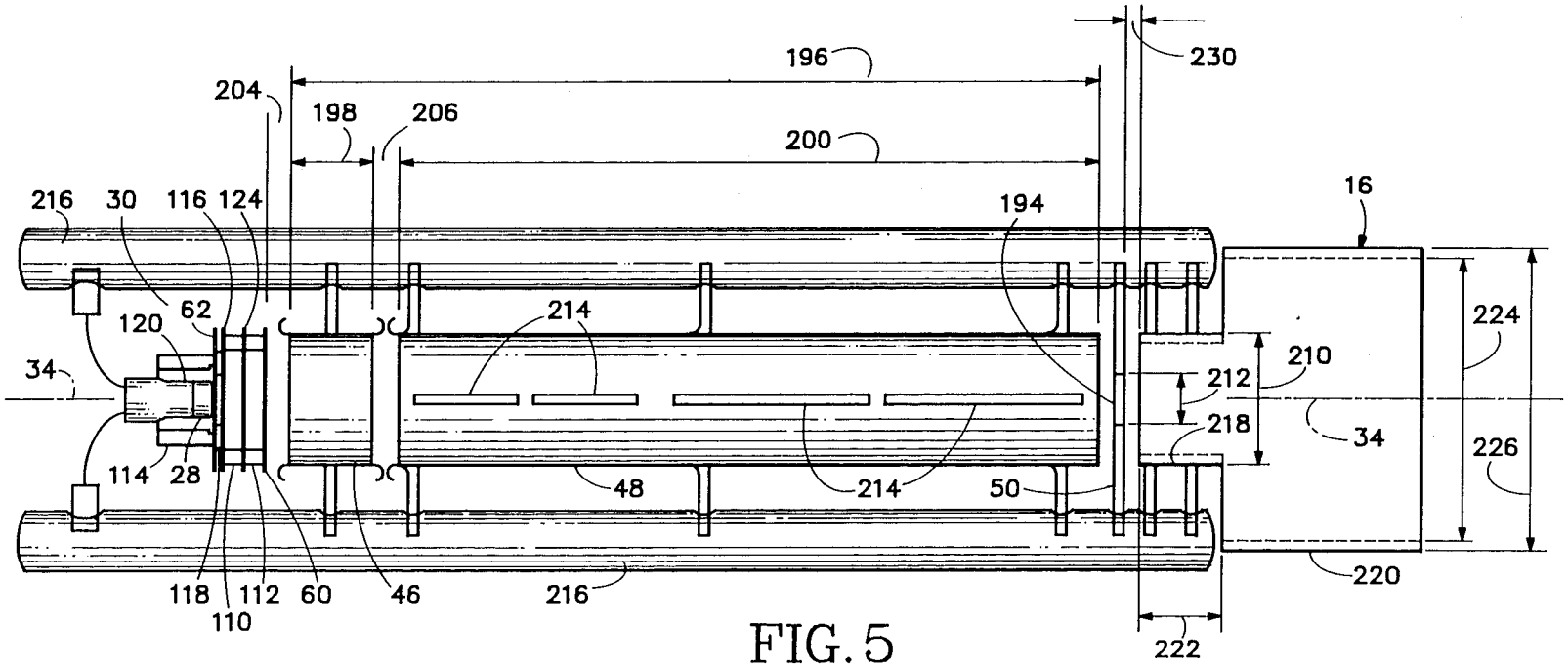
FIG. 5 is an enlarged side elevation view of a beam convergence electrode and a drift tube section that receive multiple electron beams emerging from the grid electrode structure in the cathode-ray tube of FIG. 1.

FIG. 5 shows convergence electrode structure 46 and drift tube section 48, which are positioned downstream of and receive the parallel electron beams emerging from grid electrode structure 30. Convergence electrode structure 46 and drift tube section 48 are of cylindrical shape and have their axes coincident to central longitudinal axis 34. Convergence cylinder 46 converges the bundle of eight electron beams toward central longitudinal axis 34 as they propagate through limiting aperture electrode 50. Convergence is necessary because of the generally circular, off-axis pixel array geometry defined by the apertures in electrodes 62, 116, 124, and 60 of grid electrode structure 30. In the absence of compensation of some type, this array geometry would cause a substantial number of the electrons in each beam to strike the periphery of the aperture 194 of limiting aperture electrode 50.

A preferred form of compensation entails positioning convergence cylinder 46 immediately adjacent and downstream of exit electrode 60 and biasing convergence cylinder 46 negative relative to electrode 60 and drift tube section 48. The resulting electric field developed within convergence cylinder 46 can be characterized by equipotential surfaces that develop force lines which direct the eight beams toward central longitudinal axis 34. As a consequence, a substantial number of the electrons in the eight beams shift their propagation directions and pass through aperture 194 of limiting aperture electrode 50. Passing a substantial number of the electrons through limiting aperture electrode 50 results in a reduction in beam current loss and thereby provides a brighter display.

In a preferred embodiment, a potential of between 400 volts and 1500 volts is applied to convergence cylinder 46, and a potential of between 600 and 2000 volts is applied to drift tube section 48, which is electrically connected to electrode 60 of grid electrode structure 30. The magnitude of the potentials applied to, and the combined length 196 of, convergence cylinder 46 and drift tube section 48 affect the magnification of the size of the array of electron beams. The combined length 196 of convergence cylinder 96 and drift tube section 48 is about 76.96 mm. Convergence cylinder 46 and drift tube section 48 are of a length 198 of 7.239 mm, and a length 200 of 66.29 mm, respectively. Convergence cylinder 46 is spaced apart from electrode 60 by a distance 204 of 1.27 mm and from drift tube section 48 by a distance 206 of 1.27 mm. Convergence cylinder 46 and drift tube section 48 have inner diameters 210 of about 12.7 mm, and the circular aperture 194 in limiting aperture electrode 50 has a diameter 212 of between 3.175 and 6.35 mm. Slits 214 along the length of drift tube section 48 prevent the formation of eddy currents in the magnetic fields in the drift tube section. Four glass mounting rods 216 (only two shown) provide the support for the components contained in neck 24.

Immersion lens cylinder 16 is comprised of two cylinder portions 218 and 220 of different diameters. Cylinder portion 218 has an inner diameter 210 of 12.7 mm and a length 222 of 7.62 mm. Cylinder portion 220 has an inner diameter 224 of 2.286 cm, an outer diameter 226 of 2.54 cm, and is of sufficient length to extend about 6.35 mm into tubular electrode element 18 at its entrance end. Tubular electrode element 18 has an inner diameter 228 (FIG. 1) of 31.877 cm. Cylinder portion 218 is spaced apart from aperture limiting electrode 50 by a distance 230 of 0.889 mm.

It will be obvious to those having skill in the art that many changes may be made in the above-described details of the preferred embodiment of the present invention. The scope of the present invention should, therefore, be determined only by the following claims.

I claim:

1. In a multiple beam electron discharge tube having beam-producing means for producing plural electron beams directed along a central longitudinal axis and focusing means for focusing the electron beams toward a display surface, a bipotential acceleration and convergence electrode structure, comprising:

a first cylindrical electrode element that is axially aligned with the central longitudinal axis and has an outer diameter;

a second cylindrical electrode element that is axially aligned with the central longitudinal axis, is positioned downstream of the first cylindrical electrode element, and has an inner diameter that is greater than the outer diameter of the first cylindrical electrode element, the downstream end of the first cylindrical electrode element extending into the upstream end of the second cylindrical electrode element; and voltage source means connected to the first and second cylindrical electrode elements and applying a potential difference between them to form an image array of electron beam crossovers having an image array diameter, the focusing means focusing the image array toward the display surface and providing at the display surface a display array diameter that is proportional to the image array diameter.

2. The electrode structure of claim 1 in which the voltage source means applies to the first cylindrical electrode element a potential that is negative relative to the potential applied to the second cylindrical electrode element.

3. The electrode structure of claim 1 in which the electron discharge tube comprises a portion having a cylindrical inner surface, the first cylindrical electrode element comprises an immersion lens cylinder, and the second cylindrical electrode element comprises a conductive film on the cylindrical inner surface of the electron discharge tube.

4. In a multiple beam electron discharge tube having beam-producing means for producing plural electron beams directed along a central longitudinal axis and focusing means for focusing the electron beams toward a display surface, the improvement comprising:

first array generating means receiving the plural electron beams generated by the beam producing means to form a first array of electron beam crossovers having a first diameter; and second array generating means having first and second partly overlapping cylindrical electrodes axially aligned with the central longitudinal axis to form a second array of electron beam crossovers having a second array diameter that differs from the first array diameter, the second array being focused toward the display surface by the focusing means which provides at the display surface a third array diameter that is proportional to the second array diameter.

5. The tube of claim 4 in which the second array generating means includes biasing means for applying a potential difference between the first and second electrodes.

6. The tube of claim 5 further comprising a portion having a cylindrical inner surface and in which the first cylindrical electrode includes an immersion lens cylinder and the second cylindrical electrode includes an electrically conductive film on the cylindrical inner surface of the tube.

7. The tube of claim 4 further comprising a limiting aperture electrode and convergence means positioned between the first array generating means and the second array generating means for converging the electron beams and passing them through the limiting aperture electrode.

8. In a multiple beam electron discharge tube having beam-producing means for producing plural electron beams directed along a central longitudinal axis and focusing means for focusing the electron beams toward a display screen, the improvement comprising:

first array generating means receiving the plural electron beams generated by the beam-producing means to form a first array of electron beam crossovers having a first diameter;

second array generating means including first and second partly overlapping cylindrical electrodes axially aligned with the central longitudinal axis and further including biasing means for applying a potential difference between the first and second electrodes to form a second array of electron beam crossovers having a second array diameter that differs from the first array diameter, the second array being focused toward the display surface by the focusing means which provides at the display surface a third array diameter that is proportional to the second array diameter;

deflection means for scanning the electron beams across plural scan positions on the display surface; and compensating means communicating with the deflection means for generating a compensation signal corresponding to the scan position of the electron beams, the biasing means being responsive to the compensation signal to change the potential difference applied between the first and second electrodes, whereby the deflection means magnifies the electron beams by different amounts at different scan positions and the biasing means in response to the compensation signal compensates for the different magnifications and provides substantially uniform magnification at the different scan positions.

* * * * *